US005445299A

United States Patent [19]

Harriman

[11] Patent Number: 5,445,299

[45] Date of Patent: Aug. 29, 1995

[54] TAMPER EVIDENT LOCK FOR LIQUID PUMP DISPENSER

[75] Inventor: Ron E. Harriman, Montebello, Calif.

[73] Assignee: Calmar Inc., City of Industry, Calif.

[21] Appl. No.: 236,040

[22] Filed: May 2, 1994

[51] Int. Cl.[6] ..... B67D 5/33

[52] U.S. Cl. ..... 222/153.13; 215/254; 222/340; 222/385; 222/321.9

[58] Field of Search ..... 222/153, 321, 340, 383, 222/385; 215/254

[56] References Cited

U.S. PATENT DOCUMENTS

| | | | |
|---|---|---|---|
| 3,062,416 | 11/1962 | Cooprider | 222/321 |
| 3,971,488 | 7/1976 | McRoskey et al. | 215/254 |
| 4,345,691 | 8/1982 | Burke | 222/153 X |
| 4,366,921 | 1/1983 | Kirk, Jr. | 222/153 |
| 4,373,644 | 2/1983 | Bennett | 222/153 |
| 4,384,660 | 5/1983 | Palmisano et al. | 222/153 |
| 4,479,589 | 10/1984 | Ford | 222/153 |

FOREIGN PATENT DOCUMENTS

| | | | |
|---|---|---|---|
| 2456931 | 8/1976 | Germany | 222/153 |
| 2168958 | 7/1986 | United Kingdom | 222/153 |

*Primary Examiner*—Andres Kashnikow
*Assistant Examiner*—Joseph A. Kaufman
*Attorney, Agent, or Firm*—Watson, Cole, Grindle & Watson

[57] ABSTRACT

A tamper evident, removable and anti-rotative lock for a rotatable plunger with a manually operable dispensing pump in which the plunger has a hollow stem reciprocable through an annular collar of the pump during pumping operation, the lock comprising an arcuate strip partially surrounding the stem and located between the stem and the collar when the lock is installed on the pump, the strip having at least one tooth, protuberance or rib adapted to engage the collar when the lock is installed for preventing rotation between the strip and the collar, and axially extending mating rib and groove elements on the strip and on the stem when the lock is installed on the pump for transmitting the rotative immobility to the plunger from the strip.

7 Claims, 1 Drawing Sheet

TAMPER EVIDENT LOCK FOR LIQUID PUMP DISPENSER

BACKGROUND OF THE INVENTION

This invention relates generally to a manually actuated liquid pump dispenser having a pump plunger with a stem reciprocable through a collar of the pump and normally rotatable about the longitudinal axis of the plunger, the dispenser having means for locking the plunger in its fully depressed position for shipment and storage. More particularly, the invention relates to a removable tamper evident lock element in the form of an arcuate strip for retaining the plunger in its fully depressed locked position.

A dispenser of the general class to which the present invention is directed is disclosed in U.S. Pat. No. 3,062,416 in which the plunger head is externally threaded for threaded engagement with the internal threads of a collar on the pump for locking the plunger in its fully depressed position upon plunger rotation in a given direction, such as clockwise. The dispenser is typically shipped and stored in such lock-down position such that prior to use the plunger must be unthreaded from the collar in readiness for pumping.

Another pump dispenser having a plunger lock down feature is disclosed in U.S. Pat. No. 4,479,589 in which the plunger is provided with spaced radial lugs corresponding to lug receiving notches located in the collar and a corresponding series of shoulders interspersed between the notches. With the notches and lugs in registry the plunger may be depressed and locked in its fully depressed position upon plunger rotation to dispose the lugs beneath and in engagement with the shoulders.

The plunger lock-down dispensers of the foregoing type prevent loss of liquid during handling and shipping as the container is completely sealed. However, the ease in unlocking the plunger by unthreading it from its collar invites tampering while especially on the store shelf by someone who would surreptitiously sample the product by simply unthreading the plunger and pumping the liquid product into the hands for a free sample.

Otherwise, children have been known to unlock the dispenser and pump the liquid onto the floor or elsewhere in the store creating a safety or health hazard. Moreover, during shipment, the plunger can unthread itself loose from its collar thereby causing product leakage in the shipping carton.

SUMMARY OF THE INVENTION

The invention has as its objective the provision of a removable lock which prevents the unintentional unthreading and release of the plunger from its locked down position thus avoiding the aforenoted problems occasioned during shipping and shelf storage. The removable lock, in the form of an arcuate strip interposed between the plunger stem and the collar for rotatably immobilizing the plunger, is of simple construction, easy to operate and economical to produce while preventing plunger actuation and product leakage from the container. The lock strip of the invention, if removed before purchase by the ultimate consumer, evidences tampering with the liquid product and alerts the consumer to possible removal of product from the container and/or possible tampering of the liquid product prior to sale.

In carrying out the general objective according to the invention, the tamper evident, removable and anti-rotative lock for the rotatable plunger has at least one external tooth, rib or protuberance adapted to engage the inner wall of the collar when the lock is installed for preventing rotation between the strip and the collar, and a cooperating axial rib and axial groove acting between the plunger stem and the arcuate strip transmits the rotative immobility to the plunger from the strip. The strip underlies the plunger head except for that area beneath the spout thereby exposing a pull tab for easy access which when pulled removes the strip permitting the user to simply unthread the plunger from its lock down position in readiness for pumping. The external tooth or teeth may comprise a series of one-way ratchet teeth all inclined inwardly in a common direction from one of the free ends of the arcuate strip toward the other free end thereof, the pull tab being provided at such one end to facilitate the easy removal of the strip.

DESCRIPTION OF THE PREFERRED EMBODIMENT

Figure 1:
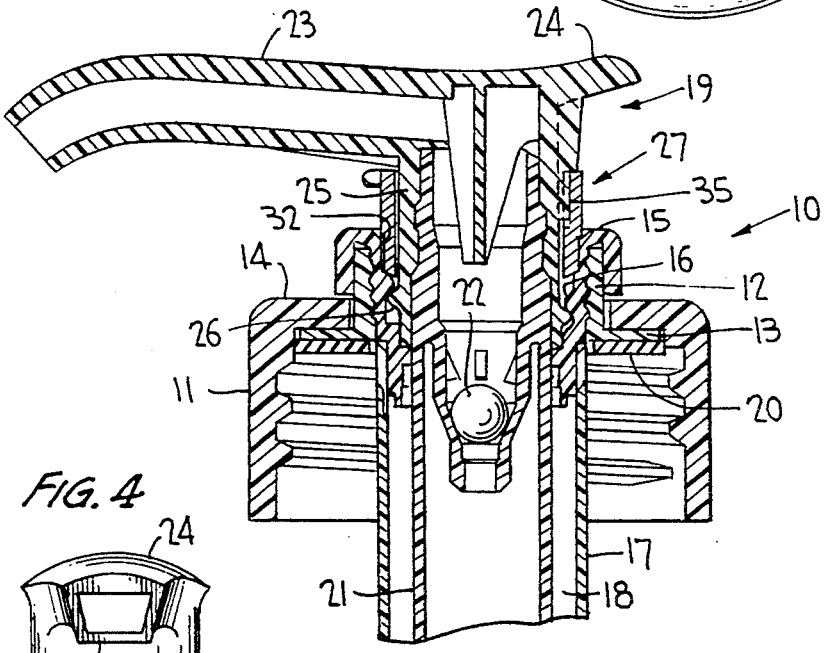
FIG. 1 is a vertical sectional view of a portion of a manually operated dispensing pump of known variety shown in its plunger locked down position and incorporating the removable locking strip of the invention.

Turning now to the drawings wherein like reference characters refer to like and corresponding parts throughout the several views, the pump dispenser, generally designated 10 in FIG. 1, is typically mounted on the neck of a container (not shown) of a product to be dispensed using an internally threaded closure 11. The pump has an external sleeve 12 with a radially extending flange 13 underlying top wall 14 of the closure, the sleeve being force fitted or otherwise secured to a collar 15 internally threaded as at 16. A container gasket 20 may underlie flange 13.

The lower end of the collar supports a depending cylinder 17 having at its lower end a dip tube (not shown) which extends into the container, and a ball check valve (not shown) being located at the lower throat end of the cylinder for controlling the intake of liquid product into pump chamber 18 formed within the cylinder. The dispensing pump is structured and operates essentially the same as that disclosed in U.S. Pat. No. 3,062,416, the entirety of the disclosure of which being specifically incorporated herein by reference.

Plunger 19 of the pump has a piston 21 (only partially shown) operating in pump cylinder 17, a discharge ball check valve 22 being supported within the plunger to control the discharge of product through spout 23 integrally formed with plunger head 24. The plunger head has a depending stem 25 to which piston 21 is affixed. The plunger stem is externally threaded as at 26 for threaded engagement with internal threads 16 to lock the plunger in its fully depressed position of FIG. 1 during shipping and storage. The plunger is freely rotatable about its longitudinal axis such that it need be rotated through about a quarter turn in its fully depressed position to lock the plunger down upon threaded engagement between threads 16 and 26.

Figure 2:
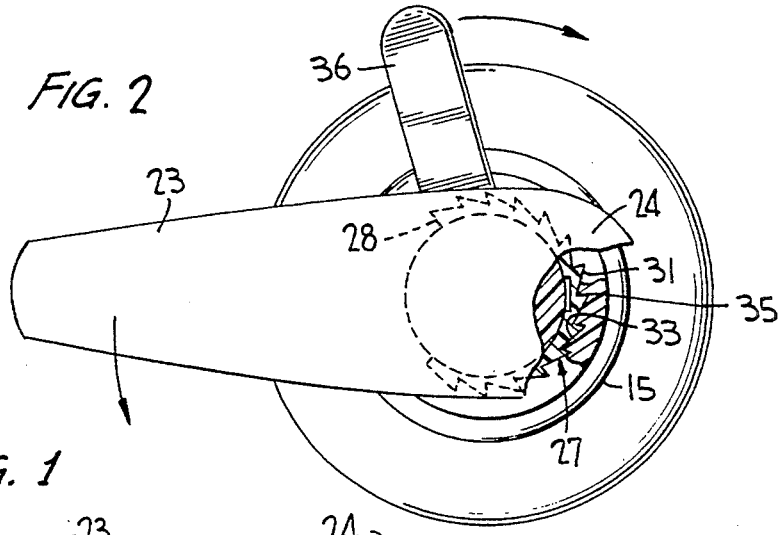
FIG. 2 is a top plan view of the dispenser of FIG. 1 partly broken away to illustrate details of the locking strip in section.
Figure 3:
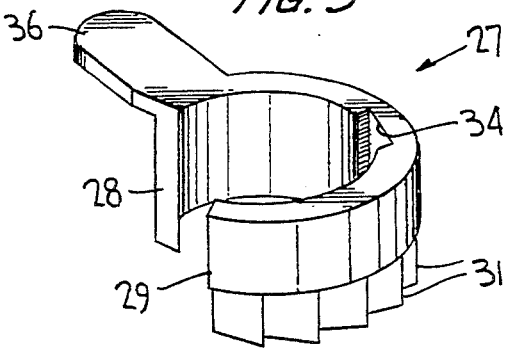
FIG. 3 is a perspective view of the locking strip of the invention.

The removable, tamper evident lock element or strip according to the invention is generally designated 27 in FIG. 3 and, as in seen in FIGS. 1 and 2, is interposed between plunger stem 25 and collar 15.

Strip 27 is of arcuate shape, partially surrounds the plunger stem, and has spaced apart opposed free ends 28, 29. At least a lower portion of the strip has at least one external tooth, rib or protrusion 31 thereon for gripping the confronting inner surface 32 of the collar 15 to prevent rotation of the strip relative to collar 15 about the central axis of the collar. In the disclosed embodiment, a series of external teeth 31 are provided on lock strip 27 in the form of one-way ratchet teeth each inwardly inclined in a direction facing free end 29. And, surface 32 may have as many internal complementary teeth or protrusions as to mate with the number of external teeth or protrusions provided on the arcuate strip. In the embodiment disclosed, the collar is formed with internal ratchet teeth 33 in mating engagement with a series of external ratchet teeth 31 on strip 27.

As clearly shown in FIG. 3, the arcuate strip is provided with an internal axially extending groove 34 for the reception of a complementary rib 35 provided on the outer wall of piston stem 25. As a full equivalent, strip 27 can be otherwise provided with an internal axial rib received within a complementary axial groove formed in the outer surface of stem 25. The rib/groove engagement between the piston stem and lock strip 27 serve to immobilize the rotatability of the plunger relative to closure 11, i.e., lock strip transmits its rotative immobility to the plunger.

A transversely extending pull tab 36 is molded on strip 27 at free end 28 to facilitate removal of the entirety of lock strip 27 when pulled by the intended user. The strip simply pulls away from in between collar 15 and plunger stem 25 upon exerting a pull force in the direction of the curved arrow associated with the pull tab shown in FIG. 2. The pull tab could otherwise be located at free end and 29, although its location at free end 28 renders it easier to disengage teeth 31 and 33 when located thereat.

As shown in FIG. 2, strip 27 partially surrounds the plunger stem and underlies essentially only that portion of plunger head 24 without underlying spout 23. In such manner, strip 27 can be easily removed without interference from spout 23.

Figure 4:
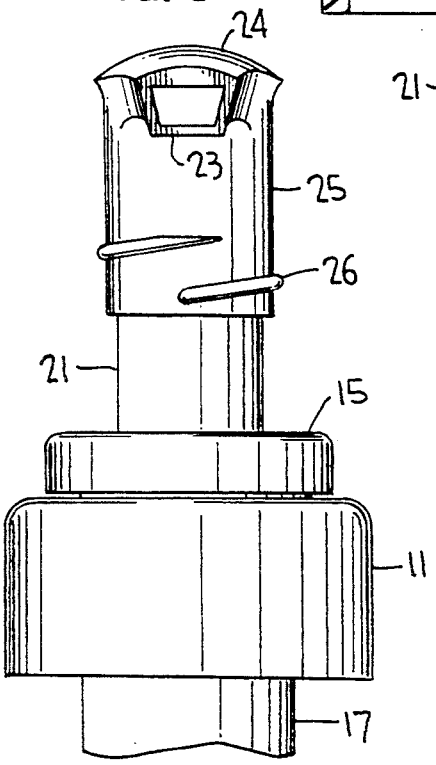
FIG. 4 is a front plan view of the FIG. 1 dispenser shown with its plunger head unthreaded from its locked down position with the locking strip removed and in readiness for pumping.

Upon removal of strip 27, the operator is free to rotate the plunger approximately one-quarter turn in the direction of the curved arrow associated with spout 23 shown in FIG. 2 to thereby unthread the plunger from collar 15 whereupon the plunger retracts to its upper position shown in FIG. 4 under the action of the piston return spring (not shown) located at the lower end of the pump cylinder. The dispenser is now placed in readiness for pumping in the normal manner.

Obviously many other modifications and variations of the present invention are made possible in light of the above teachings. It is therefore to be understood that within the scope of the appended claims the invention may be practiced otherwise than as specifically described.

What is claimed is:

1. A manually operated dispensing pump having a plunger including a stem reciprocable through a collar of the pump and normally rotatable about the longitudinal axis of the plunger, rotary means on said plunger cooperating with means on said collar for releasably locking said plunger in a fully depressed position upon rotation of said plunger in a predetermined direction, the improvement comprising a removable tamper evident lock means for holding said plunger against unlocking rotation from its fully depressed locked position, said lock means comprising an arcuate strip partially surrounding said stem and having opposed, spaced apart free ends, a laterally extending pull tab at one of said free ends, said strip having at least one external tooth in engagement with at least one internal toothed provided on an inner surface of said collar, and said strip having an internal axial groove receiving an external axial rib provided on said stem.

2. The pump according to claim 1, wherein said strip has a series of external ratchet teeth in engagement with a series of internal ratchet teeth provided on said inner surface of said collar.

3. A tamper evident, removable and anti-rotative lock for a rotatable plunger of a manually operable dispensing pump wherein the plunger has a hollow stem reciprocable through an annular collar of the pump during pumping operation, said lock comprising:

an arcuate strip having spaced apart, opposed free ends for partially surrounding said stem and for location between said stem and said collar when the lock is installed on the pump;

at least one tooth on said strip adapted to engage said collar when the lock is installed for preventing rotation between the strip and the collar; and axially extending mating rib and groove means on said strip and on the stem when the lock is installed on the pump for transmitting the rotative immobility to the plunger from the strip.

4. The lock according to claim 3, wherein a laterally extending pull tab is provided at one of said free ends of said strip for the removal of said strip.

5. The lock according to claim 3, wherein said strip has a series of external teeth adapted to engage an inner surface of said collar.

6. The lock according to claim 5, wherein said external teeth comprises one-way ratchet teeth each inclined in a common direction from one of said free ends toward the other of said free ends, said external ratchet teeth being adapted from mating engagement with internal ratchet teeth provided on said collar when the lock is installed on the pump.

7. The lock according to claim 6, wherein a laterally extending pull tab is provided at said one free end to facilitate the removal of said strip.

* * * * *